US006551372B1

(12) United States Patent
Ewing et al.

(10) Patent No.: US 6,551,372 B1
(45) Date of Patent: Apr. 22, 2003

(54) HIGH PERFORMANCE WROUGHT POWDER METAL ARTICLES AND METHOD OF MANUFACTURE

(75) Inventors: Bruce A. Ewing, Martinsville, IN (US); Sushil K. Jain, Indianapolis, IN (US); Kenneth A. Green, Greenwood, IN (US); Randolph C. Helmink, Indianapolis, IN (US); Allister James, Orlando, FL (US)

(73) Assignee: Rolls-Royce Corporation, Indianapolis, IN (US)

( * ) Notice: Subject to any disclaimer, the term of this patent is extended or adjusted under 35 U.S.C. 154(b) by 0 days.

(21) Appl. No.: 09/663,025

(22) Filed: Sep. 15, 2000

Related U.S. Application Data

(60) Provisional application No. 60/154,405, filed on Sep. 17, 1999, and provisional application No. 60/184,531, filed on Feb. 24, 2000.

(51) Int. Cl.[7] ..... C22C 33/02

(52) U.S. Cl. ..... 75/246; 419/28; 419/29; 419/49; 419/48

(58) Field of Search ..... 419/46, 49, 48, 419/29, 28; 75/246

(56) References Cited

U.S. PATENT DOCUMENTS

| | | | |
|---|---|---|---|
| 2,809,110 | A | 10/1957 | Darmara et al. |
| 3,065,072 | A | 11/1962 | Gittus et al. |
| 3,385,698 | A | 5/1968 | MacFarlane et al. |
| 3,494,709 | A | 2/1970 | Piearcey |
| 3,653,987 | A | 4/1972 | Boesch |
| 3,776,704 | A | 12/1973 | Benjamin |
| 3,850,624 | A | 11/1974 | Hulit et al. |
| 3,941,590 | A | 3/1976 | Watanabe |
| 3,976,480 | A | 8/1976 | Watanabe |
| 4,083,734 | A | 4/1978 | Boesch |
| 4,093,476 | A | 6/1978 | Boesch |
| 4,108,648 | A | 8/1978 | Zhurkina et al. |
| 4,253,885 | A | 3/1981 | Maurer et al. |
| 4,359,352 | A | 11/1982 | Ray et al. |
| 4,376,650 | A | 3/1983 | McGinness |
| 4,677,035 | A | 6/1987 | Fiedler et al. |
| 4,853,044 | A | 8/1989 | Ford et al. |
| 4,888,064 | A | 12/1989 | Chang |
| 4,935,072 | A | 6/1990 | Nguyen-Dinh |
| 5,129,971 | A | 7/1992 | Henry |
| 5,143,563 | A | 9/1992 | Krueger et al. |
| 5,374,319 | A | 12/1994 | Stueber et al. |
| 5,724,643 | A | 3/1998 | Ewing |
| 5,897,718 | A | 4/1999 | Hessell et al. |

OTHER PUBLICATIONS

The Homogenisation of Single–Crystal Superalloys. Microstructural Analysis.

An Oxidation–Resistant Coating Alloy For Gamma Titanium Aluminides.

Creep Life Extension of a Single Crystal Superalloy by Re–Heat–Treatment.

*Primary Examiner*—Daniel J. Jenkins
(74) *Attorney, Agent, or Firm*—Woodard, Emhardt, Naughton, Moriarty & McNett LLP

(57) ABSTRACT

A nickel base powder metallurgy superalloy gas turbine engine disk for a compressor or turbine. The wrought powder metallurgy gas turbine engine disk has desirable fatigue crack growth resistance and a superior balance of tensile, creep rupture and low cycle fatigue strength characteristics. In one embodiment the disk defines a segregation free homogenous structure.

39 Claims, 15 Drawing Sheets

HIGH PERFORMANCE WROUGHT POWDER METAL ARTICLES AND METHOD OF MANUFACTURE

The present application claims the benefit of U.S. provisional application Serial No. 60/154,405, filed Sep. 17, 1999 and U.S. provisional application Serial No. 60/184,531 filed Feb. 24, 2000. The provisional applications are incorporated herein by reference.

BACKGROUND OF THE INVENTION

The present invention relates generally to powder metallurgy superalloy gas turbine engine components. More particularly, one embodiment of the present invention defines a wrought powder metallurgy nickel base superalloy gas turbine engine disk having enhanced fatigue crack growth resistance and a superior balance of mechanical properties. Although the present invention was developed for gas turbine engine components, certain applications may be in other fields.

The performance of a gas turbine engine is generally limited by the high temperature performance of the gas turbine engine's compressor and turbine disks, blades and vanes. In a typical gas turbine engine fuel and air are mixed and burned, and the hot combustion gas flow is directed against the vanes, which turn the gas flow against the turbine blades. The blades are mounted on the turbine disk, and the rotation of the turbine disk generates power which can be used to draw more air into the engine and drive a propulsion device such as a fan or propeller. The gas turbine engine disks, blades and vanes must therefore operate in an extremely hostile environment, of high temperature, high loading, fatigue, oxidation and corrosion. Gas turbine engine designers have focused much effort to improving the performance of materials that are used to fabricate the gas turbine engine's disks, blades and vanes.

For more than thirty years there has been continuing development on materials to enable engine components, such as compressor and turbine disks, to be operated under more rigorous conditions. A nickel base superalloy known as Waspaloy was introduced in 1967, and is still used in many applications today despite it's limitations of strength and maximum temperature of use. A cast/wrought-nickel base superalloy UDIMET 720 (UDIMET is a registered trademark of Special Metals Corporation) was introduced by Special Metals Corporation for selected components such as turbine blades used in industrial gas turbine engines. However, early applications of cast/wrought UDIMET 720 to aircraft gas turbine engine disk applications were hampered because the compositions used for disk forgings were susceptible to chemical segregation that can lead to low yields and a wide variability in grain size and heat treatment response. Further, problems were also encountered related to the formation of boride and carbide stringers that can act as nucleation sites that lead to early fatigue cracking and premature component failure.

In the 1980's several changes were made to the processing methods and the chemistry used for a disk component formed from cast/wrought UDIMET 720 to address the prior limitations. As an example, melt practices were changed from a double melt (vacuum induction melt plus vacuum arc remelt) to a triple melt (vacuum induction melt plus electroslag remelt plus vacuum arc remelt) to minimize contamination and improve structure. Elements that can lead to the formation of stringers were analyzed and adjusted. More specifically, the carbon and boron levels were reduced from the levels in the earlier material. Further, the chromium levels were also reduced to prevent deleterious sigma phase formation.

The continued advancement in gas turbine engine designs requires the freedom to utilize significantly larger disks having enhanced micro-structural control and quality levels. Further, many modern design parameters require a disk material having defect tolerance, while maintaining resistance to burst yielding and fatigue crack initiation. Defect tolerance generally means that disks must have the capability to operate with either manufacturing defects that might escape non-destructive inspection during processing or post manufacturing defects that might arise from handling or service induced distress.

Heretofore, there has been a need for a high strength and defect tolerant disk for a gas turbine engine. The present invention satisfies this and other needs in a novel and unobvious way.

SUMMARY OF THE INVENTION

One form of the present invention contemplates a wrought powder metallurgy nickel based superalloy gas turbine engine disk.

Another form of the present invention contemplates a process of making a wrought powder metallurgy nickel based superalloy gas turbine engine disk. The disk is substantially free of chemical segregation and has grain sizes that promote a unique balance of fatigue crack growth resistance, low cycle fatigue capability, creep rupture strength and tensile properties.

Another form of the present invention contemplates a dual microstructure wrought powder metallurgy disk having a coarse grained rim and a fine grained bore.

Yet another form of the present invention contemplates a gas turbine engine disk, comprising: a main body member formed of a gamma prime strengthened wrought powder metallurgy composition consisting essentially of, in weight percent, 0.015%–0.035% carbon, 15.5%–16.5% chromium, 14%–15.5% cobalt, 2.75%–3.25% molybdenum, 4.75%–5.25% titanium, 2.25%–2.75% aluminum, 1%–1.5% tungsten, 0.030%–0.090% zirconium, 0.020%–0.050% boron, up to 0.90% hafnium, and the balance nickel plus incidental impurities; and the main body member has a substantially segregation free homogenous microstructure having an average grain size within a range of ASTM 5 (25 microns) to ASTM 14 (3 microns).

One aspect of the present invention contemplates a process of preparing a nickel base powder metal superalloy gas turbine engine disk, comprising: furnishing a composition consisting essentially of, in weight percent, 0.015%–0.035% carbon, 15.5%–16.5% chromium, 14%–15.5% cobalt, 2.75%–3.25% molybdenum, 4.75%–5.25% titanium, 2.25%–2.75% aluminum, 1%–1.5% tungsten, 0.030%–0.090% zirconium, 0.020%–0.050% boron, up to 0.90% hafnium, and the balance nickel plus incidental impurities; consolidating the composition to produce a preform member; thermomechanically working the preform to produce a wrought member; and, heat treating the wrought member.

One object of the present invention is to provide a unique gas turbine engine disk.

Related objects and advantages of the present invention will be apparent from the following description.

DESCRIPTION OF THE PREFERRED EMBODIMENTS

Figure 1:
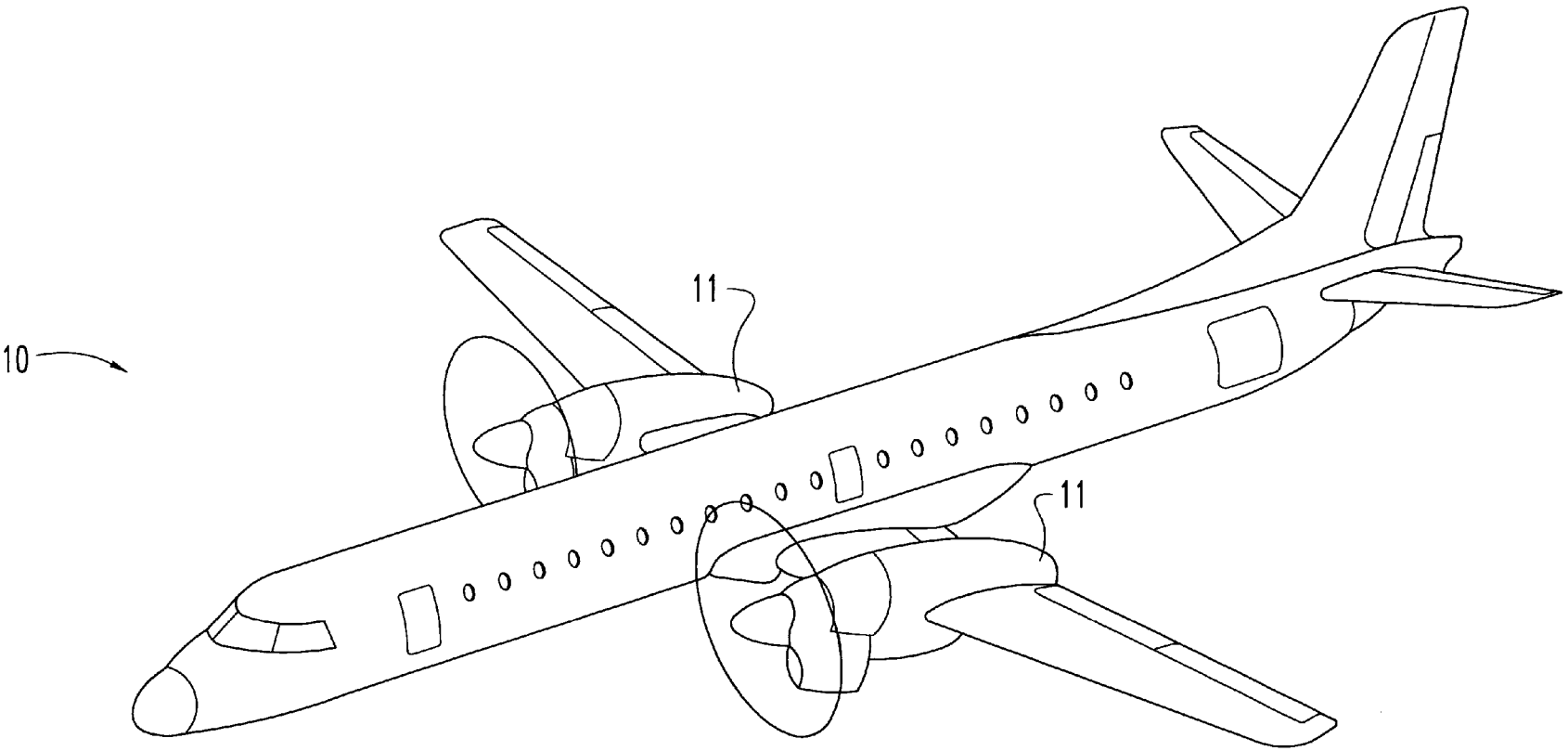
FIG. 1 is a perspective view of an aircraft having one embodiment of a gas turbine engine coupled thereto.

For the purposes of promoting an understanding of the principals of the invention, reference will now be made to the embodiment illustrated in the drawings and specific language will be used to describe the same. It will, nevertheless, be understood that no limitation of the scope of the invention is thereby intended, and such alterations and further modifications of the illustrated device, and such further applications of the principals of the invention as illustrated therein being contemplated as would normally occur to one skilled in the art to which the invention relates.

Figure 2:
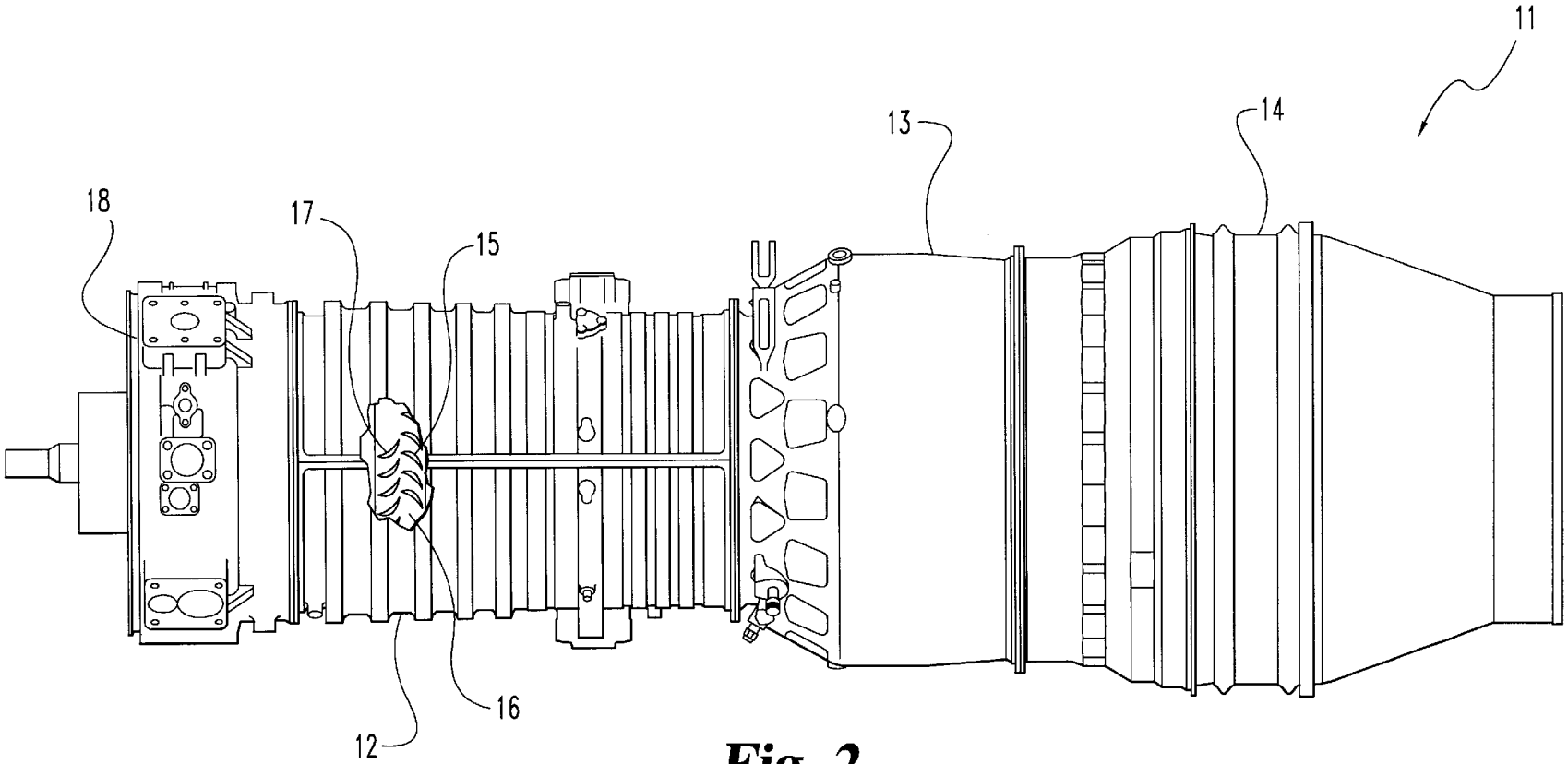
FIG. 2 is a partially fragmented enlarged side elevational view of the gas turbine engine of FIG. 1.

With reference to FIGS. 1 and 2, there is illustrated an aircraft 10 having an aircraft flight propulsion engine 11. The term aircraft is generic and includes helicopters, airplanes, missiles, unmanned space devices and other related apparatuses. One embodiment of the flight propulsion 11 defines a gas turbine engine integrating a compressor 12, a combustor 13 and a power turbine 14. It is important to realize that there are a multitude of ways in which the gas turbine engine components can be linked together. Additional compressors and turbines can be added with the intercoolers connecting between the compressors and reheat combustion chambers could be added between the turbines. Further, in an alternate embodiment the flight propulsion engine includes a compressor section, a turbine section, a combustor section and a fan section.

A gas turbine engine is equally suited to be used for an industrial application. Historically, there has been widespread application of industrial gas turbine engines such as pumping sets for gas and oil transmission lines, electricity generation and shipboard propulsion. A plurality of compressor blades 15 is coupled to a rotor disk 16 that is affixed to a shaft rotatable within the gas turbine engine 11. It is understood herein that the compressor may contain, but is not limited to, between one and fifteen stages. The forward stages of the compressor will be located closest to the forward end 18 of the gas turbine engine 11. While the present disclosure utilized the compressor as an example, a person of ordinary skill in the art will appreciate that the turbine 14 also includes a rotor disk with a plurality of blades coupled thereto. Further, the plurality of vanes 17 may be conventionally joined together to collectively form a complete 360° nozzle.

Figure 3:
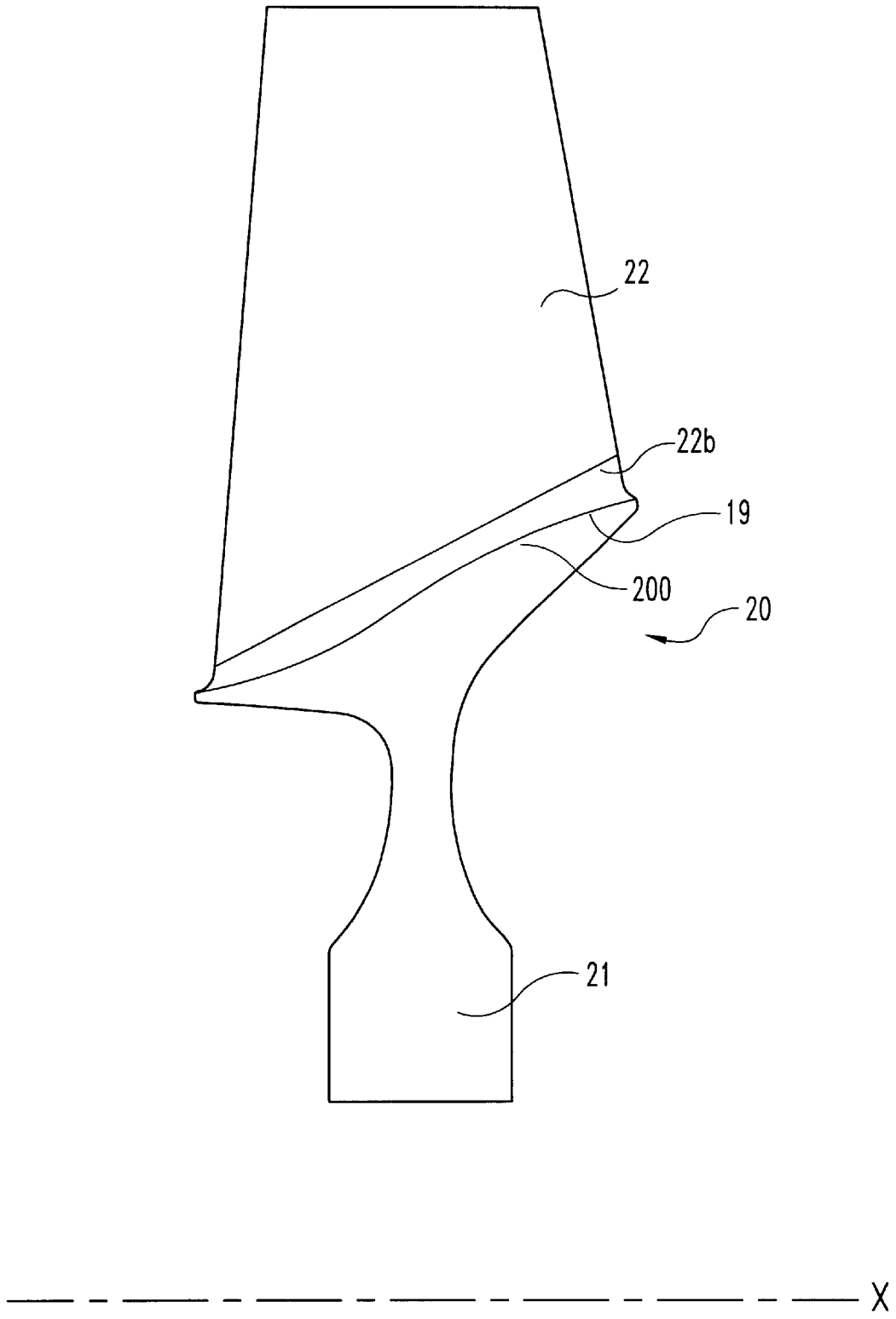
FIG. 3 is an illustrative view of an integrally bladed rotor disk comprising one embodiment of the present invention.

With reference to FIG. 3, there is disclosed one embodiment of an integrally bladed rotor disk 20 including a plurality of airfoils 22 extending radially therefrom. The integrally bladed rotor disk 20 is rotatable within engine 11 and has a wheel/disk portion 21 that is symmetrical about a centerline X. Each of the plurality of airfoils 22 are metallurgically connected at an attachment end **22*b* to an outer wheel/disk peripheral location 19 by diffusion bonding, fusion welding, linear friction welding, forge bonding or brazing. In one embodiment the rotor disk 20 includes a rim portion 200 and a bore portion 201**. Further, the present invention is applicable to a blisk design wherein the airfoils are integrally bonded to a ring that is coupled to a disk. U.S. Pat. No. 4,270,256 to Ewing discloses one type of a blisk design and is incorporated herein by reference.

Figure 4:
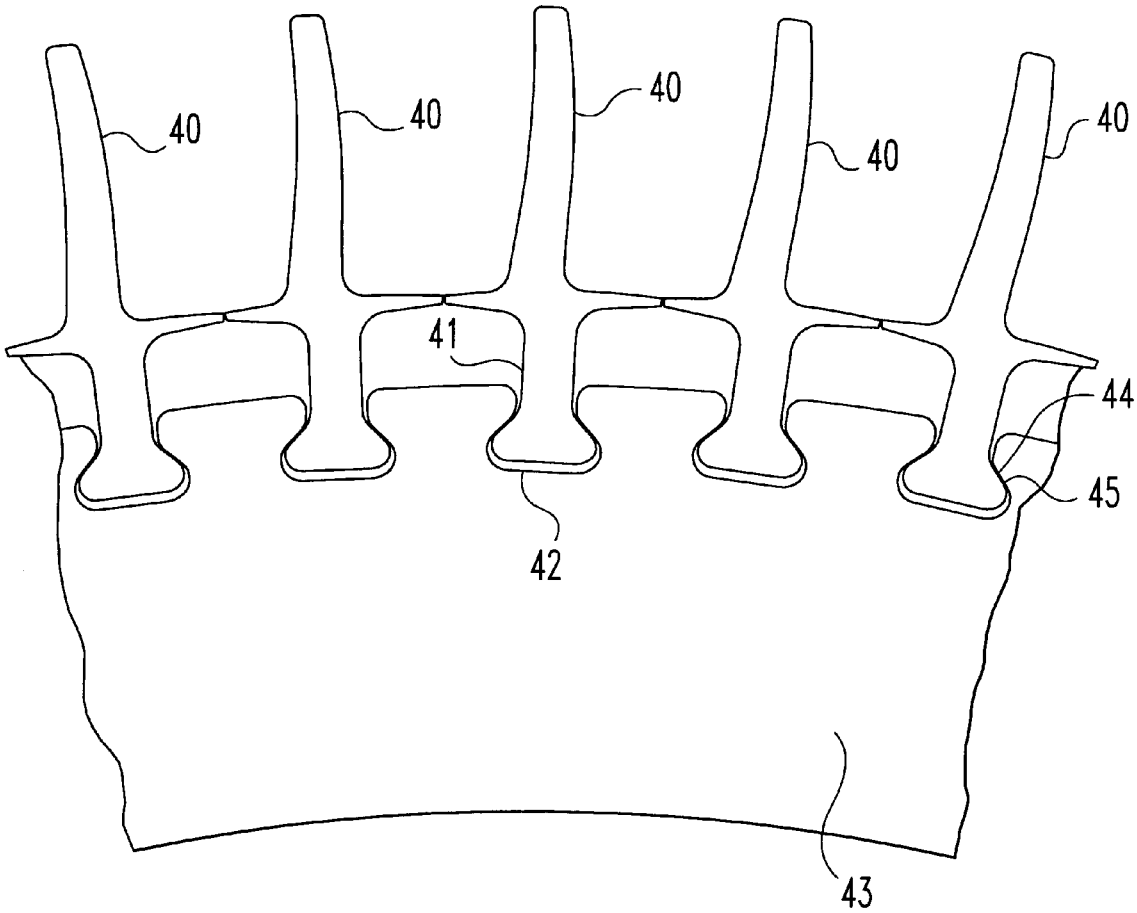
FIG. 4 is a partial illustrative view of a rotor disk comprising an alternate embodiment of the present invention.

With reference to FIG. 4, there is illustrated a partial view of a rotor disk 43 having a plurality of airfoils 40 coupled thereto. The plurality of airfoils 40 is not integrally connected to the rotor disk 43 and each of the airfoils 40 includes an attachment portion 41. The attachment portion 41 is receivable within a corresponding attachment receiving portion 42 of the rotor disk 43. The integral attachment portion 41 includes a protuberance 44 that mates with a correspondingly shaped surface 45 defined in the attachment-receiving portion 42. The attachment portion 41 is known to a person of ordinary skill in the art and includes, but is not limited to, a dovetail, a firtree, and a pinned root.

In one embodiment the present invention defines a wrought powder metallurgy superalloy article. The article can be defined by a gas turbine engine component, including but not limited to: a compressor disk; a turbine disk; a spacer; a coverplate seal; an integrally bladed compressor disk (blisk) and a structural casing. One preferred embodiment defines a disk for carrying an airfoil within the gas turbine engine. Hereinafter, the term disk will include compressor and turbine disks unless specifically limited to the contrary. In a preferred form, the finish machined disks have a diameter within a range of about 4 inches to 32 inches, and a finish machined weight within a range of about 4 pounds to about 400 pounds. In one embodiment the finish machined disks are substantially circular, and have a thickness within a range of: about 0.75 inches to 6.0 inches in the bore location; and about 0.25 inches to about 2.0 inches in the web location; and about 0.5 inches to about 3.0 inches in the rim location. However, disks having other sizes, diameters, thickness and weights are contemplated herein as would be desirable in the full spectrum of gas turbine engines.

In one form the article defines a defect tolerant wrought powder metallurgy superalloy structure which exhibits enhanced fatigue crack growth resistance, as well as a unique balance of tensile, creep rupture, and low cycle fatigue strength characteristics. Further, in one form the present invention includes an article having a dual microstructure featuring a first portion having a coarser grain structure than the grain structure of a second portion. More preferably, the article is a dual microstructure wrought powder metal disk having a coarse grained rim and a fine grained bore. However, the present invention is not limited to articles having dual microstructures and the present invention includes articles having a single microstructure and a plurality of microstructures. Set forth below in Table I is one composition in weight percent. An alternate composition is substantially identical to the composition of Table I, except there is no Hafnium present in the alternate composition. As utilized herein the term balance relates to the predominant nickel alloying element and may include small amounts of impurities and incidentals which in character and/or amount do not adversely affect the advantageous aspects of the material, unless specifically recited to the contrary. In one form of the composition the small amount of impurities and incidentals comprise not more than 300 parts per million oxygen, less than 0.10% nitrogen, and less than 0.75% iron. However, as set forth above other small amounts of impurities and incidentals are contemplated herein provided they do not adversely affect the advantageous aspects of the material.

TABLE I

| | | | |
|---|---|---|---|
| C | .005 | TO | .04 |
| Cr | 14.5 | TO | 17.5 |
| Co | 13.0 | TO | 16.5 |
| Mo | 2 | TO | 4 |
| Ti | 4.5 | TO | 5.5 |
| Al | 2.0 | TO | 3.25 |
| W | .75 | TO | 1.75 |
| Zr | .03 | TO | 1.0 |
| B | 0.005 | TO | 0.06 |
| Hf | up | TO | 1.0 |
| Ni | BALANCE | TO | BALANCE |

With reference to Table II there is illustrated a more preferred composition in weight percent. An alternate composition contains the same elements as the composition of Table II except there is no Hafnium present in the alternate composition. As utilized herein the term balance relates to the predominant nickel alloying element and may include small amounts of impurities and incidentals which in character and/or amount do not adversely affect the advantageous aspects of the material, unless specifically recited to the contrary. In one form of the composition the small amount of impurities and incidentals comprise not more than 300 parts per million oxygen, less than 0.10% nitrogen, and less than 0.75% iron. However, as set forth above other small amounts of impurities and incidentals are contemplated herein provided they do not adversely affect the advantageous aspects of the material.

TABLE II

| | | | |
|---|---|---|---|
| C | .015 | TO | .035 |
| Cr | 15.5 | TO | 16.5 |
| Co | 14.0 | TO | 15.5 |
| Mo | 2.75 | TO | 3.25 |
| Ti | 4.75 | TO | 5.25 |
| Al | 2.25 | TO | 2.75 |
| W | 1.0 | TO | 1.5 |
| Zr | .030 | TO | .090 |
| B | .020 | TO | .050 |
| Hf | UP | TO | .90 |
| Ni | BALANCE | TO | BALANCE |

In order to achieve the desired properties and microstructure of the article a process including the following acts may be employed: (1) form a melt of the desired alloy composition; (2) atomize the melt to produce powder metal particles; (3) consolidate the powder metal particles to produce a preform suitable for hot working; (4) thermomechanically work the preform to produce a wrought product; and (5) heat treat the wrought product to produce the desired grain size and microstructure. The combination of the composition of matter and preferred processing facilitates the forming of a segregation free homogenous structure and desired grain sizes that promote a superior balance of fatigue crack growth resistance, low cycle fatigue capability, creep rupture strength and tensile properties.

A vacuum induction process is utilized to melt the desired composition of matter. The molten composition is atomized by a gas to produce powder particles. Procedures for forming powder metal particles are well known to one of ordinary skill in the art. In one method known to those of skill in the art the molten metal is melted in a vacuum induction furnace and gravity fed through a ceramic nozzle. As the molten metal travels out of the nozzle a jet of inert gas is impinged on the stream of molten metal. The inert gas atomizes the molten metal and the powder metal particles are collected in an inert gas filled chamber beneath the nozzle. In one preferred embodiment the inert gas is argon, and in another embodiment, the inert gas is nitrogen. After atomization of the molten metal the powder metal particles are screened and classified by size.

The powder metal particles from the atomization act are then consolidated. Consolidation of the powder metal particles can be accomplished by a number of different techniques which include, but are not limited to, vacuum hot pressing, hot-isostatic-pressing, hot compaction, extrusion, and combinations thereof over a temperature range of about 1950° F. to about 2125° F. In one example of the present invention, the powder metal compositions produced in the atomization stage were classified as 150 mesh (about 100 micron) particles and introduced into mild steel cans. However, other powder metal particle sizes are contemplated herein. During the filling of the mild steel cans they were vibrated to enhance the tap density of the material within the cans. Thereafter, the cans were evacuated and sealed shut by welding. In one form the cans were first outgassed at room temperature and then heated to about 350° F. under vacuum to ensure the removal of water vapor. After outgassing the cans were sealed off by welding. In the example the cans were about four and five-eighths inches in diameter and had a length of about eight and three-eighths inches and contained about twenty-five pounds of powder metal material. After the welding operation the metal cans with the powder metal particles sealed therein were subjected to a hot isostatic pressing operation. The hot isostatic pressing operation had a temperature of about 2065° F. and a pressure of about 15.0 KSI for a duration of about four hours.

A chemical analysis of the hot isostatically pressed cans revealed that they contained less than 150 parts per million oxygen. Microscopic examination of the consolidated material within the cans showed a fully consolidated uniform structure containing a large amount of gamma prime precipitates. The analysis resulted in finding a very fine grain size on the order of about ASTM 11 (8 microns).

In one alternate embodiment of the present invention a spray forming technique is utilized to produce the preform. Spray forming is believed generally known to one of ordinary skill in the art and involves the spraying of an atomized stream of molten metal onto a forming mandrel.

The consolidated preform is then subjected to a wrought/thermomechanical processing operation including, but not limited herein to extruding, forging, rolling, co-extruding, and combinations thereof. The thermomechanical processing and heat treat techniques are varied to develop desired grain sizes for components formed from the group of alloys. The average grain sizes are preferably within a range of ASTM 5 (about 25 microns) to ASTM 14 (about 3 microns).

In the example described above the consolidated preforms were subjected to an isothermal forging technique. More particularly, the forgings developed in this example were on the order of about one inch in thickness and nine inches in diameter. The thermomechanical processing and heat treat techniques were varied to develop two specific grain sizes for each of a group of alloys. The grain sizes and thermomechanical processing/solution heat treat technique for each alloy in the example were established as follows: (1) ASTM 9 (about 16 microns) target grain size-1990° F. thermomechanical processing temperature and a supersolvus solution heat treatment at 2140° F. for two hours and followed by a fan air quench; ASTM 11 target grain size-2065° F. thermomechanical processing temperature and a subsolvus solution heat treatment at 2065° F. for two hours followed by a fan air quench. Subsequent to the forging and solution heat treatment the forgings were aged for eight hours at about 1400° F. and air cooled to room temperature. This was followed by a second aging at about 1200° F. for about 24 hours and then air cooled to room temperature. The resulting microstructures in the examples were uniform and free of chemical segregation.

Another thermomechanical processing/solution heat treat technique to develop an ASTM 9 (about 16 microns) target grain size for each alloy preferably utilizes a thermomechanical working temperature within a range of about 1875° F. to about 2100° F., and a supersolvus solution heat treatment within a range of about 2130° F. to about 2150° F. for a length of time within a range of about one to about four hours and followed by cooling at a rate of about 60° F./minute to about 600° F./minute to room temperature. In one embodiment the thermomechanical processing/solution heat treat process to develop an ASTM 9 (about 16 microns) target grain size for each alloy utilizes a thermomechanical working temperature of about 1990° F., and a supersolvus solution heat treatment at 2140° F. for two hours and followed by cooling at a rate of about 60° F./minute to about 600° F./minute. Subsequent to the thermomechanical processing and supersolvus solution heat treatment the component is subjected to a first aging process wherein the component is aged for eight hours at about 1400° F. and air cooled to room temperature. In another form of the present invention the first aging process ages the component between about four and twelve hours. The first aging process is followed by a second aging process at about 1200° F. for about 24 hours and then air cooled to room temperature. In another form of the present invention the second aging process ages the component between about eight hours and thirty hours. In an alternate embodiment the second aging process is undertaken before the first aging process. The process is designed to develop microstructures that are uniform and substantially free of chemical segregation.

In another embodiment the thermomechanical processing/solution heat treat process utilized to develop an ASTM 11 (about 8 microns) target grain size for each alloy preferably utilizes a thermomechanical working temperature within a range of about 1875° F. to about 2100° F., and a subsolvus solution heat treatment within a range of about 2020° F. to about 2065° F. for a length of time within a range of about one to about four hours and followed by cooling at a rate of about 60° F./minute to about 600° F./minute to room temperature. In another embodiment the thermomechanical processing/subsolvus solution heat treat process to develop an ASTM 11 (about 8 microns) target grain size for each alloy utilizes a thermomechanical working temperature of about 2065° F., and a subsolvus solution heat treatment at about 2065° F. for two hours and followed by cooling at a rate of about 60° F./minute to about 600° F/minute to room temperature. Subsequent to the thermomechanical processing and subsolvus solution heat treatment the component is subjected to a first aging process wherein the component is aged for eight hours at about 1400° F. and air cooled to room temperature. In another form of the present invention the first aging process ages the component between about four and twelve hours. The first aging is followed by a second aging process at about 1200° F. for about 24 hours and then air cooled to room temperature. In another form of the present invention the second aging process ages the component between about eight hours and thirty hours. In an alternate embodiment the second aging process is undertaken before the first aging process. The resulting microstructures are designed to be uniform and free of chemical segregation.

The term solvus temperature refers technically to the gamma prime solvus temperature. Gamma prime solvus temperature is the temperature at which the gamma prime is fully dissolved in the gamma matrix. The term supersolvus temperature refers to the temperature above the gamma prime solvus temperature. For the family of alloys discussed herein, the gamma prime solvus temperature is about 2125° F.

It is well known to those skilled in the art that powder metal nickel superalloys can be grain coarsened by supersolvus solution heat treatment. It is also well known that supersolvus solution heat treatment processing of a cast/wrought article produces unacceptable grain size uniformity. Further, it is well known that grain coarsening improves resistance to fatigue crack growth, dwell fatigue crack growth, creep and stress rupture while reducing yield strength and low cycle fatigue crack initiation resistance.

With reference to Table III, there is presented four powder metallurgical compositions (B,C, D and E) in weight percent which were processed to powder metallurgical articles in accordance with the present invention. In addition, a superalloy composition (A) was prepared as a baseline for comparative purposes. Higher levels of boron and zirconium were studied and were designed to enhance the grain boundary strength and an addition of hafnium was examined to improve stress rupture resistance. The composition (B) was developed to evaluate the effects of hafnium relative to the baseline composition (A). The compositions (C and E) were developed to evaluate the effects of higher percentages of boron relative to the baseline composition (A). Composition (D) was developed to evaluate the effects of increased zirconium relative to composition (C). A prophetic composition was developed that is defined by the composition of Alloy (D) and which includes about 0.75% hafnium in place of a corresponding weight percent of nickel. The compositions are listed in weight percent. As utilized herein the term balance relates to the predominant nickel alloying element and may include small amounts of impurities and incidentals which in character and/or amount do not adversely affect the advantageous aspects of the material, unless specifically recited to the contrary.

TABLE III

| | | C | B | Zr | Cr | Ti | Al | Co | Mo | W | Hf | Ni |
|---|---|---|---|---|---|---|---|---|---|---|---|---|
| Alloy A | Goal | .025 | .020 | .035 | 16.00 | 5.00 | 2.50 | 14.75 | 3.00 | 1.25 | — | Bal |
| (Baseline) | Actual | .028 | .024 | .044 | 15.92 | 4.87 | 2.46 | 14.50 | 3.00 | 1.25 | — | |
| Alloy B | Goal | .025 | .020 | .035 | 16.00 | 5.00 | 2.50 | 14.75 | 3.00 | 1.25 | .75 | Bal |
| | Actual | .026 | .020 | .056 | 15.99 | 4.96 | 2.36 | 14.53 | 2.98 | 1.31 | .74 | |
| Alloy C | Goal | .025 | .030 | .035 | 16.00 | 5.00 | 2.50 | 14.75 | 3.00 | 1.25 | — | Bal |
| | Actual | .026 | .029 | .041 | 15.85 | 4.90 | 2.42 | 14.47 | 3.01 | 1.27 | — | |
| Alloy D | Goal | .025 | .030 | .070 | 16.00 | 5.00 | 2.50 | 14.75 | 3.00 | 1.25 | — | Bal |
| | Actual | .028 | .027 | .073 | 15.88 | 5.06 | 2.40 | 14.40 | 3.00 | 1.26 | — | |
| Alloy E | Goal | .025 | .040 | .035 | 16.00 | 5.00 | 2.50 | 14.75 | 3.00 | 1.25 | — | Bal |
| | Actual | .028 | .039 | .036 | 15.95 | 5.06 | 2.36 | 14.52 | 2.97 | 1.32 | — | |

In order to evaluate the above materials (A–E) that were processed to an article, mechanical property tests were performed for each alloy/grain size combination as follows: (1) tensile test-room temperature and at 1200° F.; (2) creep rupture test-1250° F./115 KSI and 1350 ° F./70 KSI; (3) low cycle fatigue-1200 ° F.; and (4) fatigue crack growth rate-1200 ° F.

Figure 5:
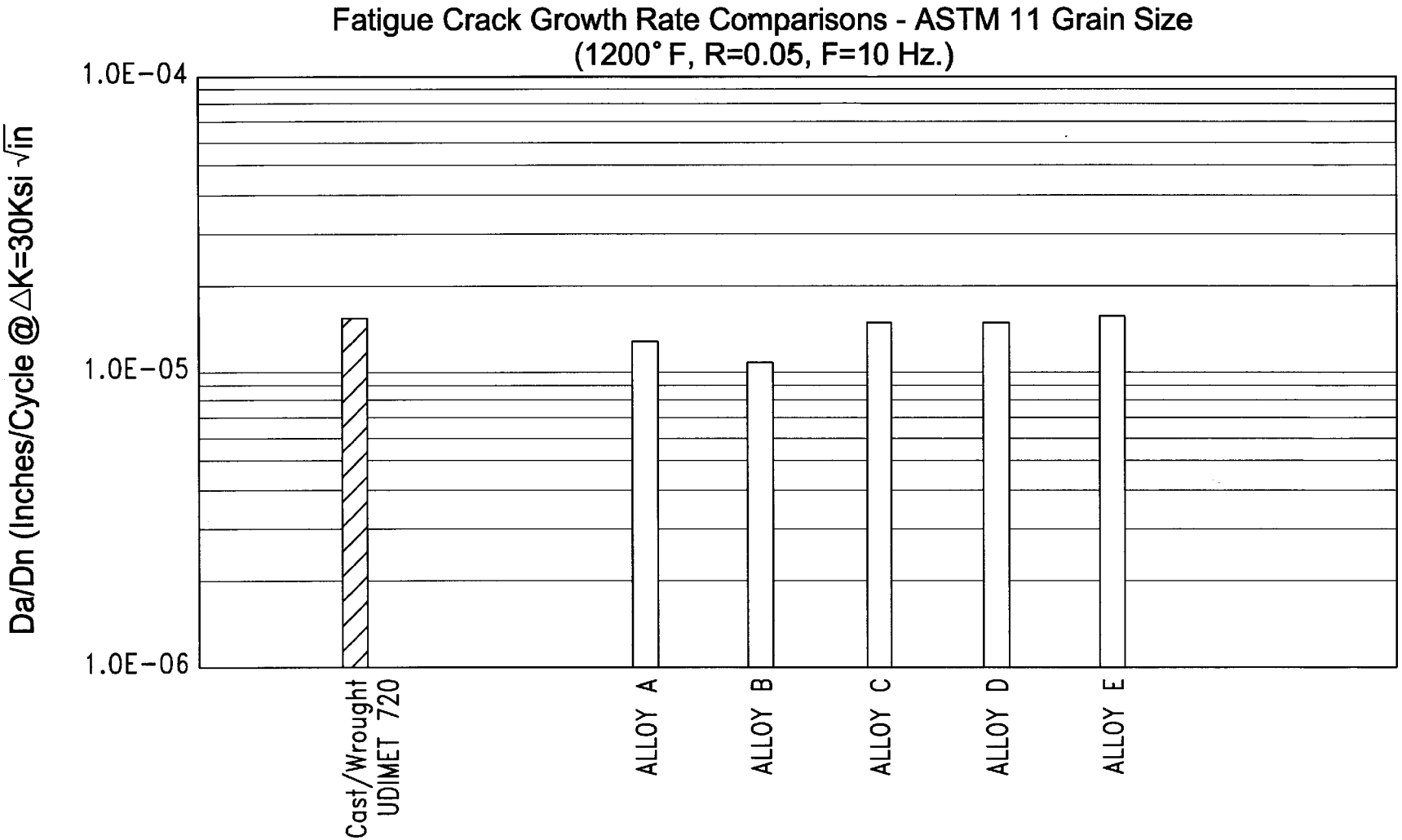
FIG. 5 is a graph illustrating Fatigue Crack Growth Rate comparisons for a group of powder metallurgy superalloys having an ASTM 11 grain size at test conditions of 1200° F., R=0.05 and F=10 Hz.

With reference to FIG. 5, there is illustrated a comparison of the fatigue crack growth rates of articles formed of the alloys (A–E) processed in accordance with the present disclosure to an ASTM 11 grain size and traditional cast/wrought UDIMET 720 triple melted and processed to a target grain size of ASTM 12. The nominal composition for the cast/wrought UDIMET 720 is as follows in weight percent: 0.015 C; 0.017 B; 0.035 Zr; 16.0 Cr; 5.0 Ti; 2.5 AL; 14.75 Co; 3.0 Mo; 1.25 W; and the balance NI. The comparisons were done under test conditions of 1200° F., R=0.05 and at a frequency of 10 cycles per second. The term R refers to the ratio of minimum to maximum stress and the term frequency refers to the number of times a second the test specimen is exposed to a minimum to maximum to minimum stress cycle. As indicated in the comparative data the hafnium modified composition (B) which was processed to an ASTM 11 grain size had the most favorable fatigue crack growth resistance when there was no dwell time in the test condition.

Figure 6:
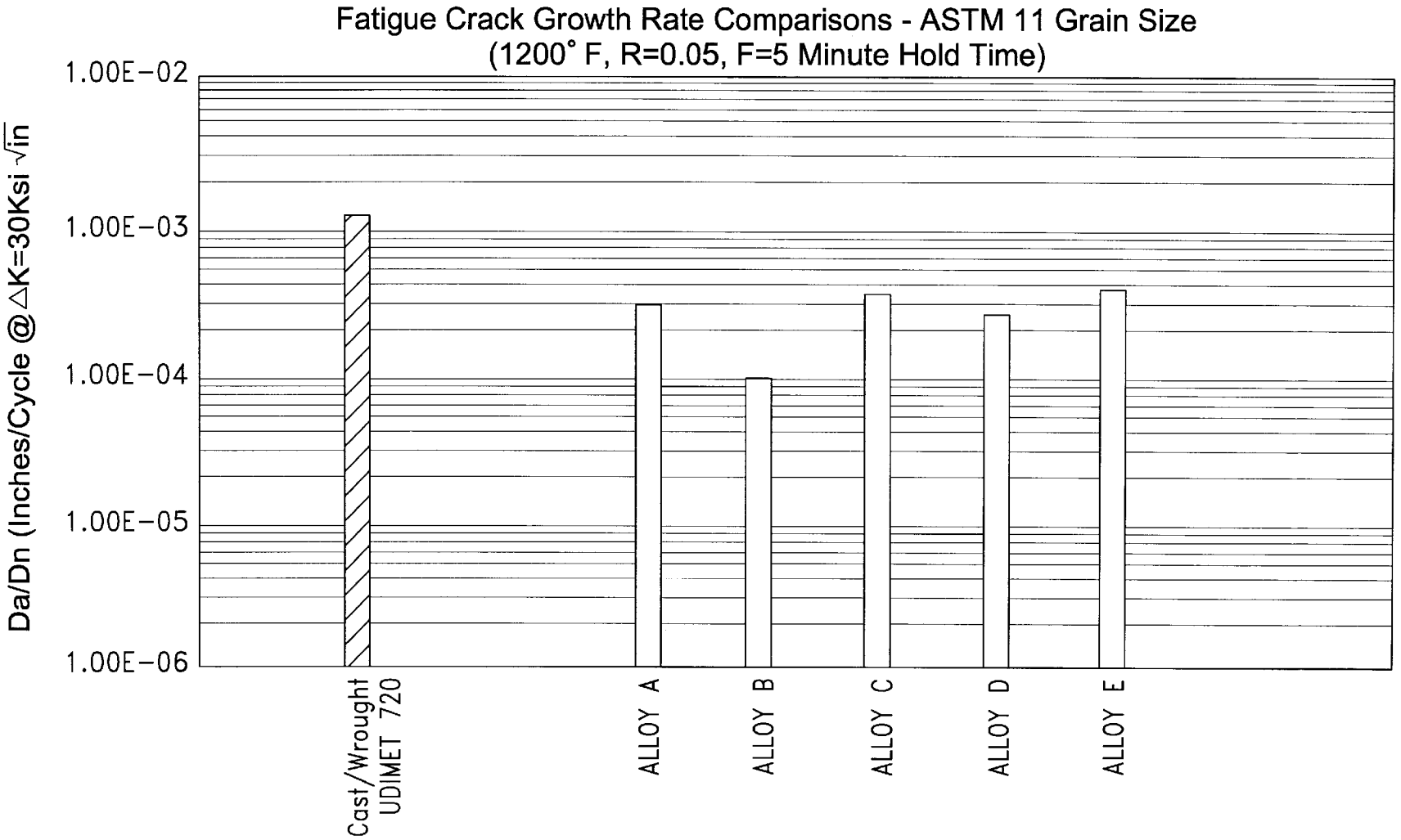
FIG. 6 is a graph illustrating Fatigue Crack Growth Rate comparisons for a group of powder metallurgy superalloys having an ASTM 11 grain size at test conditions of 1200° F., R=0.05 and F=5 minutes hold time.

Referring to FIG. 6, there is illustrated a comparison of the fatigue crack growth rates of alloys (A–E) processed in accordance with the present disclosure to an ASTM 11 grain size and traditional cast/wrought UDIMET 720 triple melted and processed to a target grain size of ASTM 12. The comparisons were done under test conditions of 1200° F., R=0.05 and at a hold time of five minutes. The hold time of five minutes is at maximum stress, then the test sample is returned to cyclic loading. As indicated in the comparative data the composition (B) which was processed to an ASTM 11 grain size had the most favorable fatigue crack growth resistance when there was a five minute hold time. Further, each of the alloys (A–E) had a favorable fatigue crack growth resistance relative to cast/wrought UDIMET 720.

Figure 7:
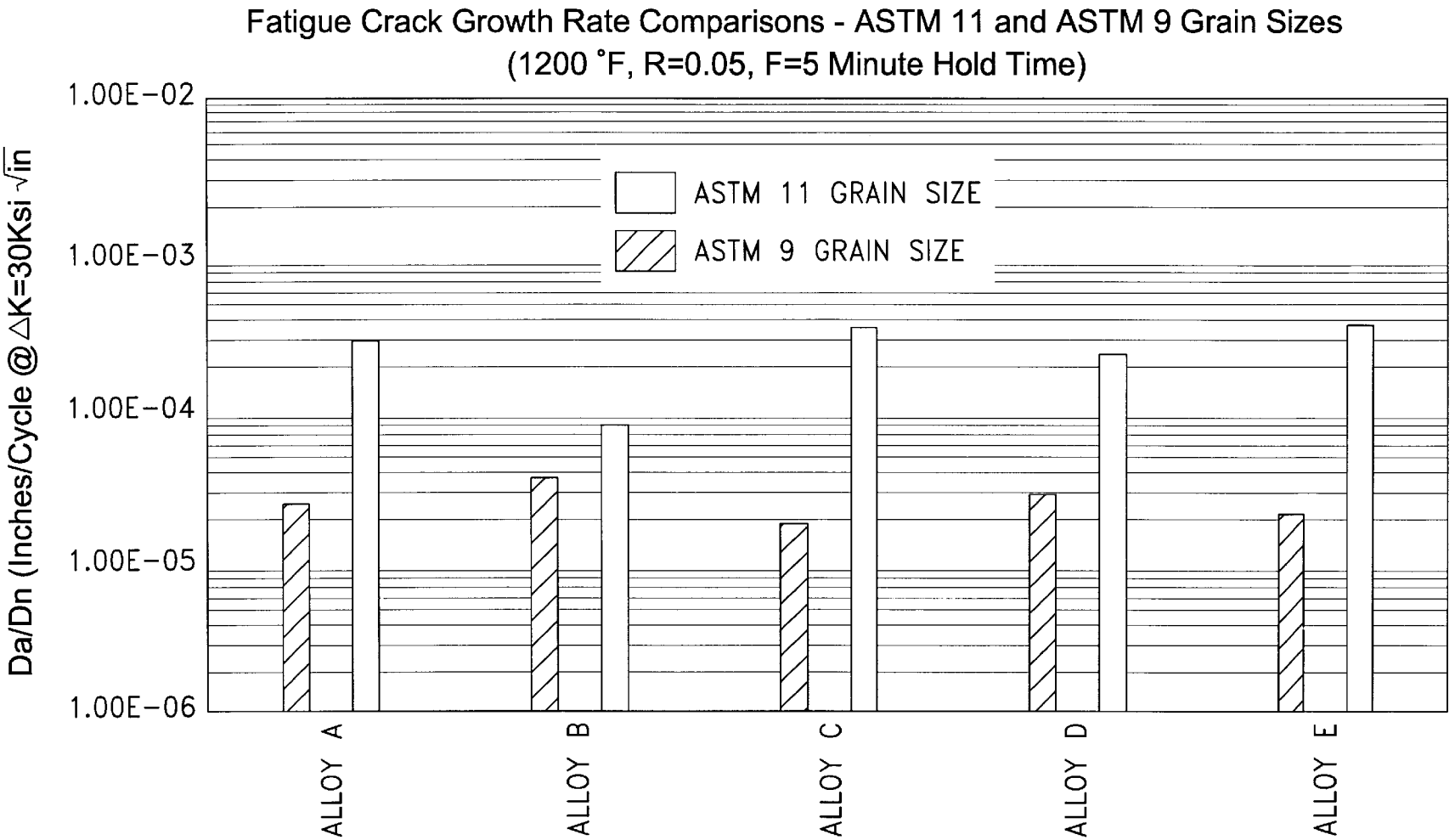
FIG. 7 is a graph illustrating Fatigue Crack Growth Rate comparisons for a group of powder metallurgy superalloys having ASTM 11 or ASTM 9 grain sizes at test conditions of 1200° F., R=0.05 and F=5 minutes hold time.

With reference to FIG. 7, there is illustrated a comparison of the fatigue crack growth rates of alloys (A–E) processed in accordance with the present disclosure to an ASTM 11 and an ASTM 9 grain size. The comparisons were done under test conditions of 1200° F., R=0.05 and at a hold time of five minutes. The data supports that when the powder metallurgical alloy was processed to the coarser ASTM 9 grain size there were significant improvements in the fatigue crack growth resistance at the 1200° F./five minute hold time test condition.

Figure 8:
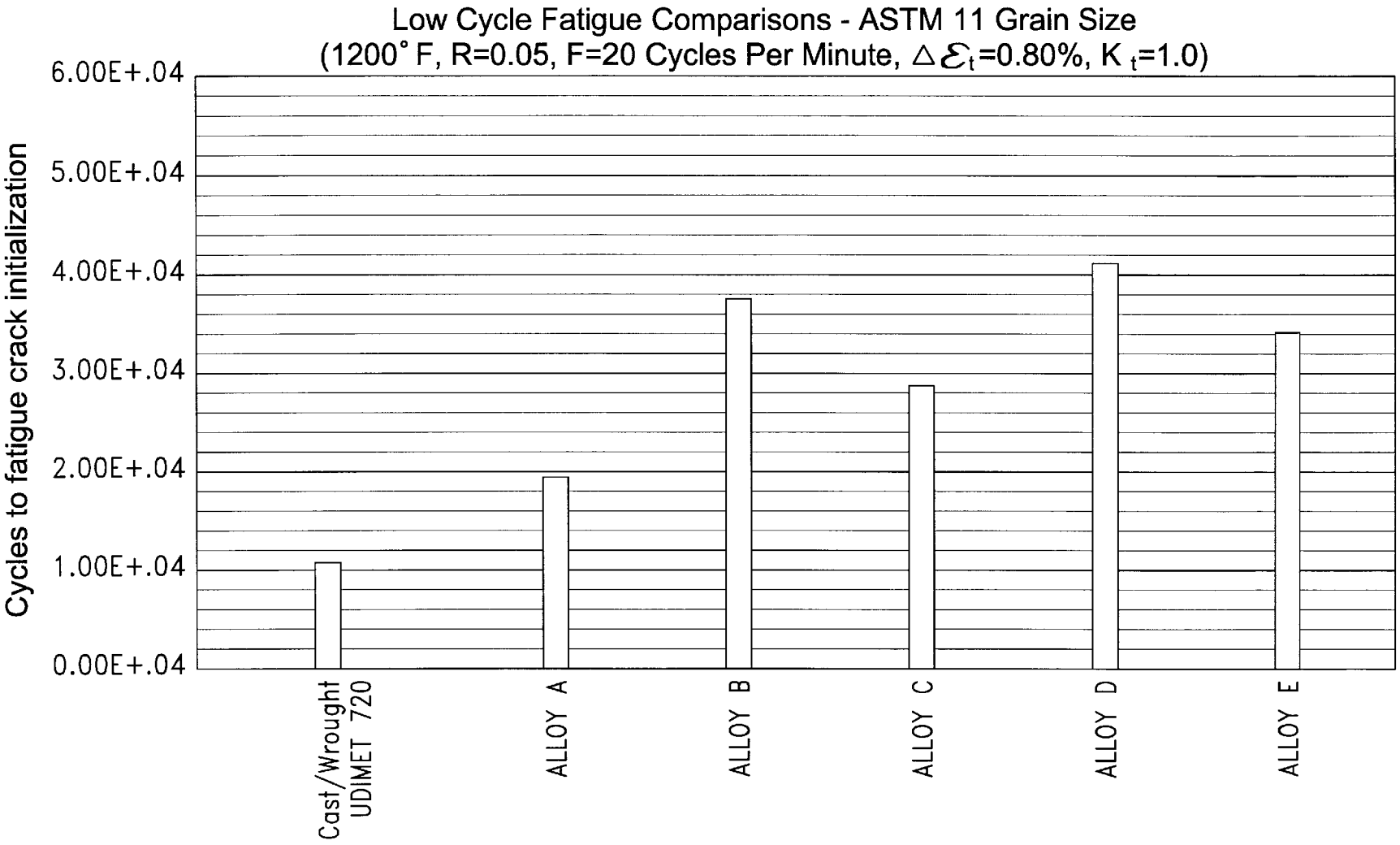
FIG. 8 is a graph illustrating Low Cycle Fatigue comparisons for a group of powder metallurgy superalloys having an ASTM 11 grain size at test conditions of 1200° F., R=0.05, F=20 cycles per minute, $\Delta\epsilon_t$=0.80% and $K_t$=1.0.

With reference to FIG. 8, there is illustrated a comparison of the low cycle fatigue testing results of alloys (A–E) processed in accordance with the present disclosure to an ASTM 11 grain size. The comparisons were done under test conditions of 1200° F., R=0.05, F=20 cycles per minute, Kt=1.0, and $\Delta\epsilon_t$=0.80%. The data set forth in FIG. 8 supports that all of the alloys (A–E) processed to a grain size of ASTM 11 were superior to cast/wrought UDIMET 720 triple melted and processed to a target grain size of ASTM 12. The hafnium modified composition (B) and the boron/zirconium modified composition (D) provided the best performance when tested in low cycle fatigue.

Figure 9:
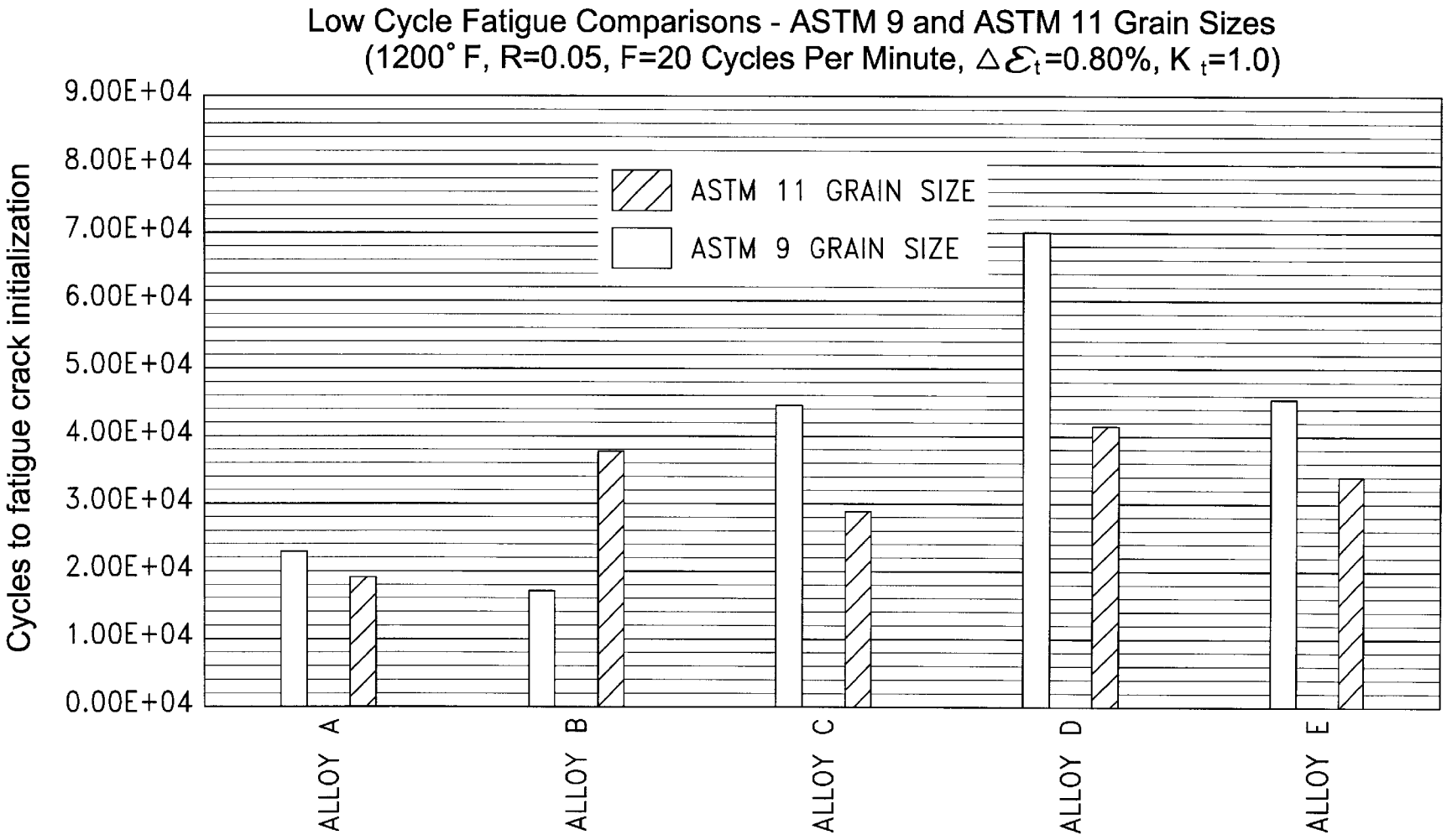
FIG. 9 is a graph illustrating Low Cycle Fatigue comparisons for a group of powder metallurgy superalloys having ASTM 11 or ASTM 9 grain sizes at test conditions of 1200° F., R=0.05, F=20 cycles per minute, $\Delta\epsilon_t$=0.80% and $K_t$=1.0.
Figure 10:
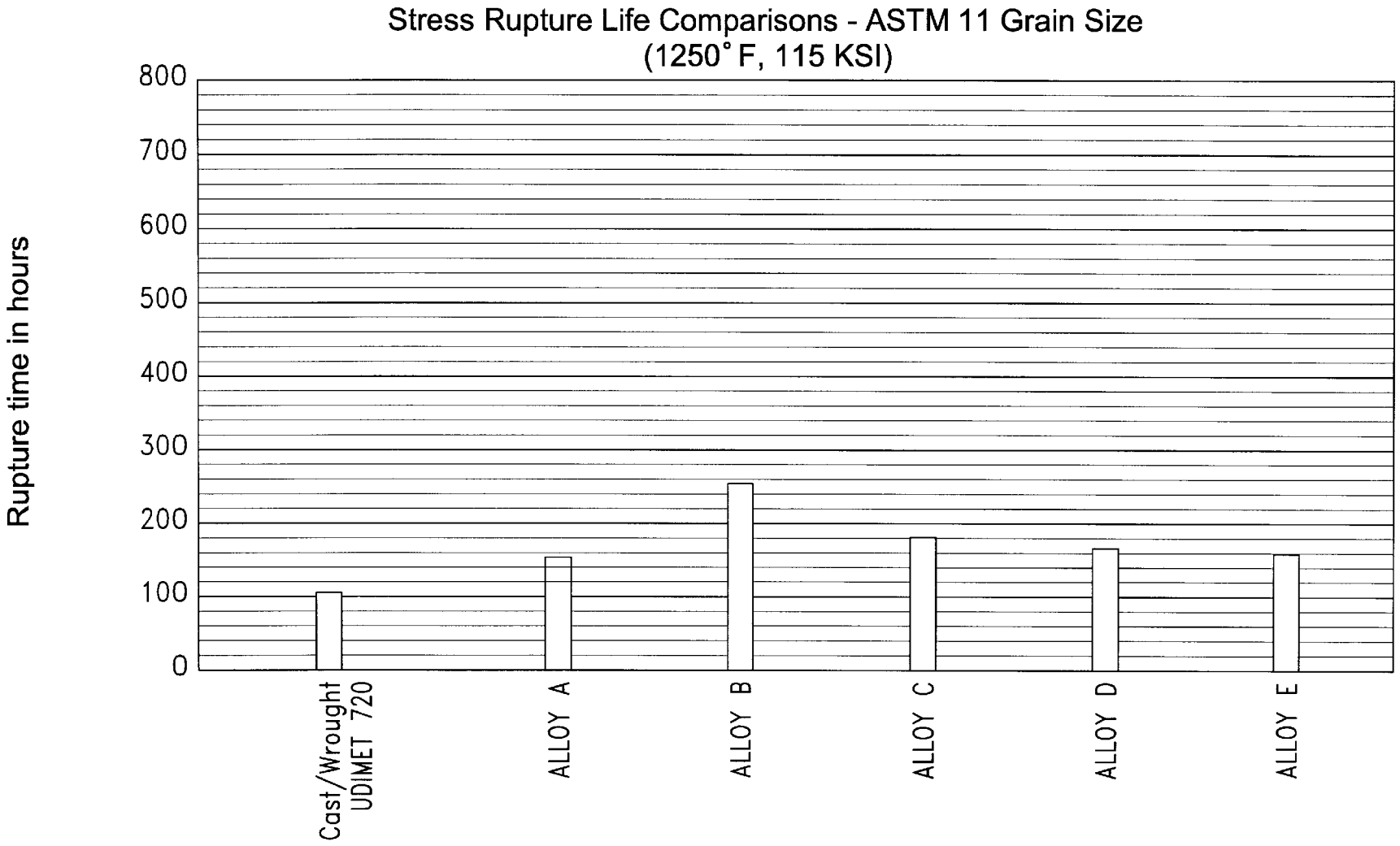
FIG. 10 is a graph illustrating Stress Rupture Life comparisons for a group of powder metallurgy superalloys having an ASTM 11 grain size at test conditions of 1250° F. and 115 KSI.
Figure 11:
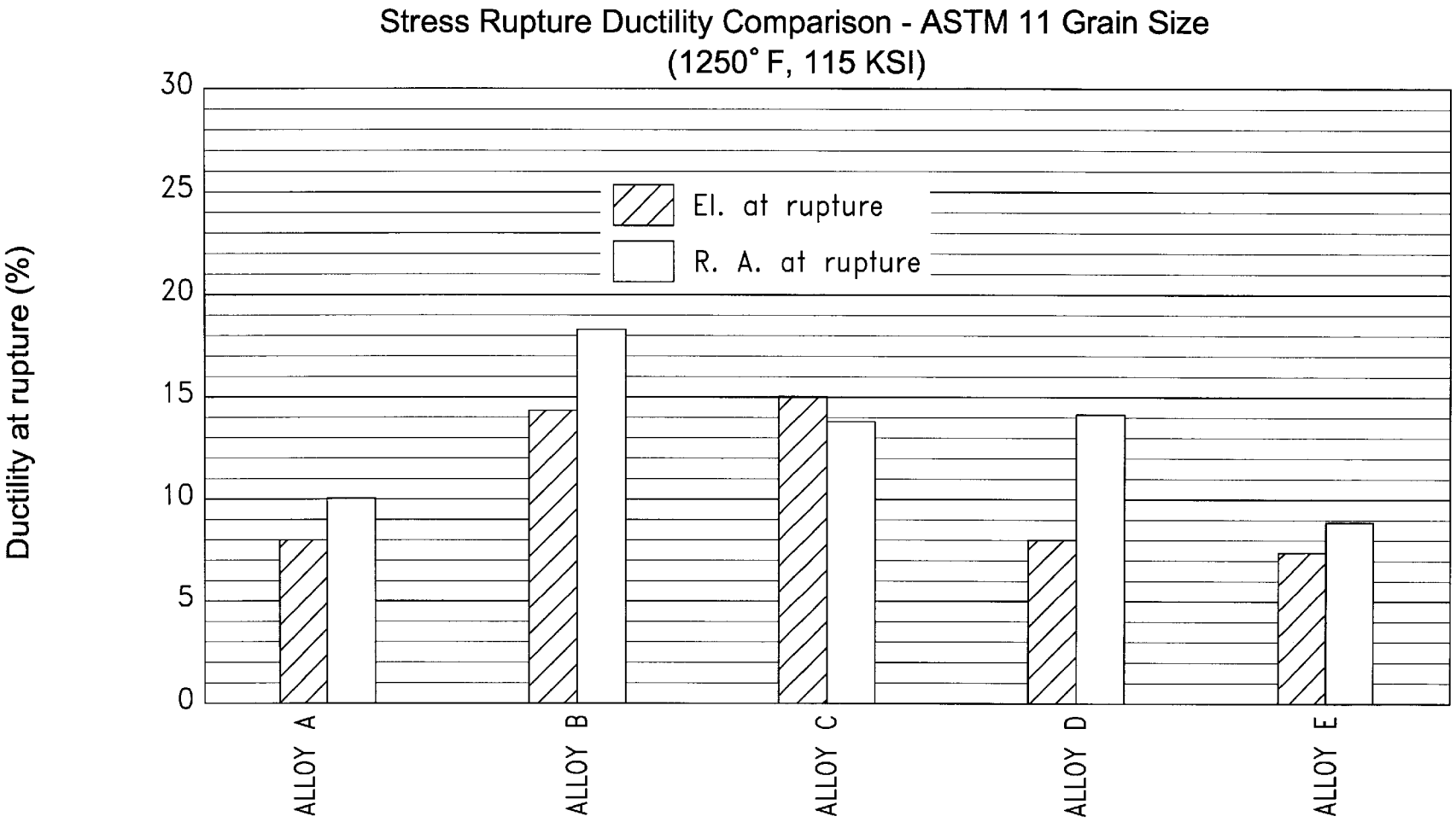
FIG. 11 is a graph illustrating Stress Rupture Ductility comparisons for a group of powder metallurgy superalloys having an ASTM 11 grain size at test conditions of 1250° F. and 115 KSI.
Figure 12:
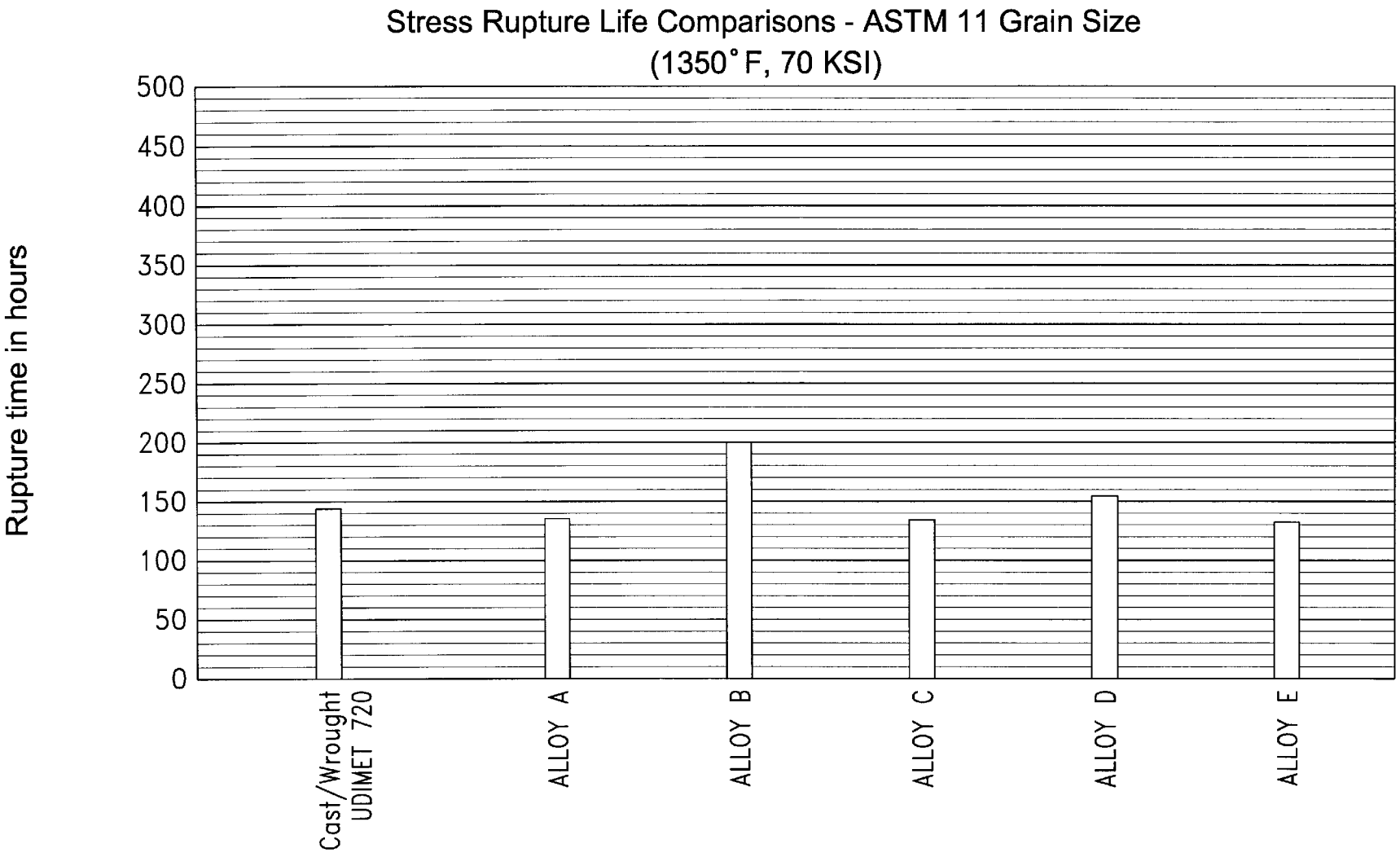
FIG. 12 is a graph illustrating Stress rupture Life comparisons for a group of powder metallurgy superalloys having an ASTM 11 grain size at test conditions of 1350° F. and 70 KSI.
Figure 13:
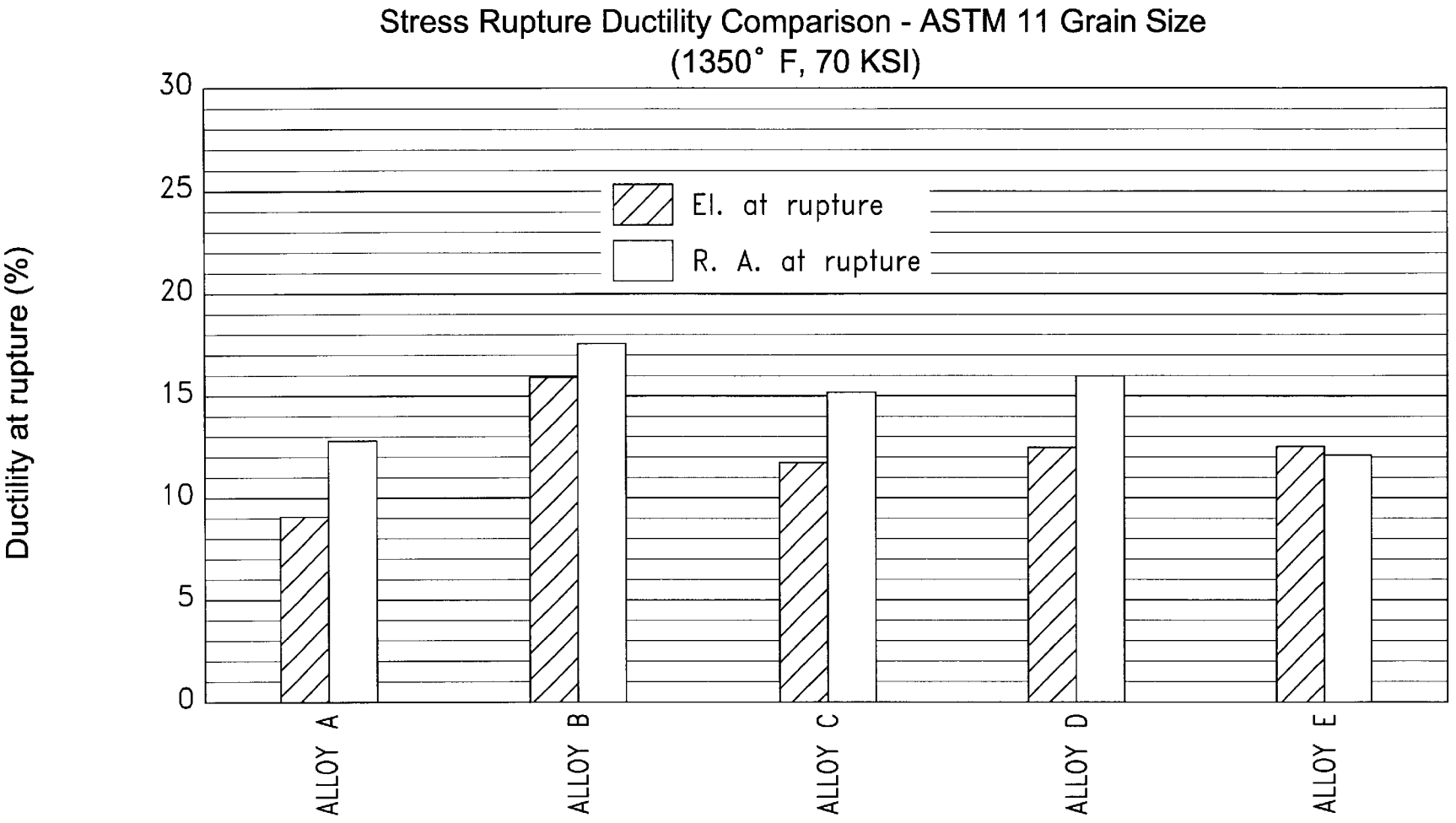
FIG. 13 is a graph illustrating Stress Rupture Ductility comparisons for a group of powder metallurgy superalloys having an ASTM 11 grain size at test conditions of 1350° F. and 70 KSI.

With reference to FIG. 9, there is illustrated a comparison of the low cycle fatigue test results of alloys (A–E) processed in accordance with the present disclosure to an ASTM 11 and an ASTM 9 grain size. The comparisons were done under test conditions of 1200° F., R=0.05, F=20 cycles per minute, Kt=1.0, and $\Delta\epsilon_t$=0.80%. The test data supports a conclusion that the low cycle fatigue performance of the coarser grain size material (ASTM 9) was generally superior to the finer grain size counterparts (ASTM 11). These results were unexpected as it has been generally accepted that for a given alloy, finer grain sizes are more fatigue crack initiation resistant than coarse grain sizes. The results also showed that the higher boron and zirconium levels conferred an enhanced and unexpected benefit to fatigue crack resistance.

With reference to FIGS. 10–13, there is illustrated a comparison of the stress rupture test results of alloys (A–E) and UDIMET 720 processed in accordance with the present disclosure to an ASTM 11 grain size. The comparisons were done using a smooth bar specimen configuration under test conditions of 1250° F. and 115 KSI, and 1350° F. and 70 KSI. Observed in the test results is the superior stress rupture life and ductility characteristics of the hafnium composition (B) relative to the other compositions and the cast/wrought UDIMET 720 processed to a target grain size of ASTM 12

Figure 14:
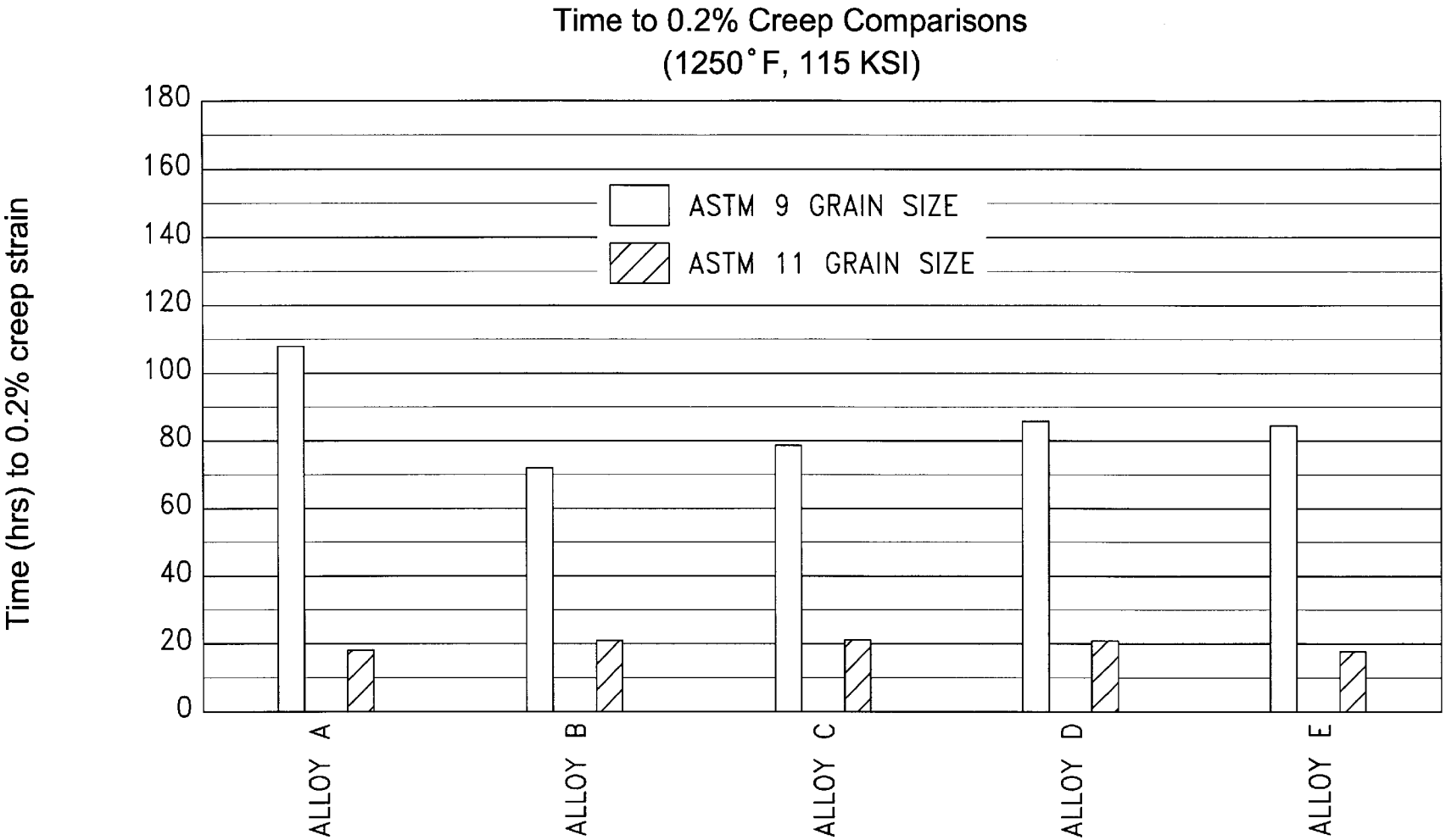
FIG. 14 is a graph illustrating the time to 0.2% creep for a group of powder metallurgy superalloys having ASTM grain sizes of 9 and 11 at test conditions of 1250° F. and 115 KSI.
Figure 15:
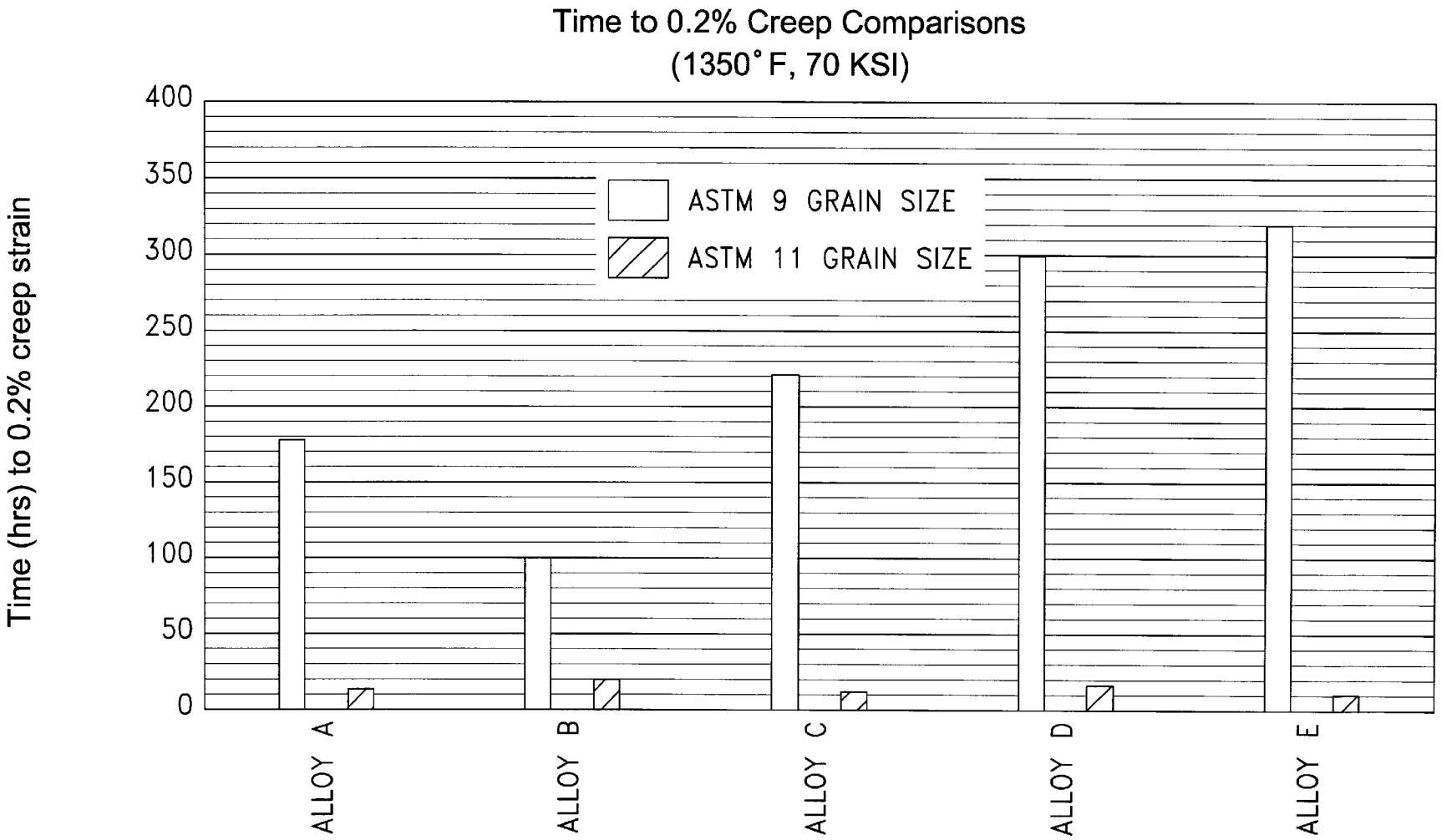
FIG. 15 is a graph illustrating the time to 0.2% creep for a group of powder metallurgy superalloys having ASTM grain sizes of 9 and 11 at test conditions of 1350° F. and 70 KSI.

With reference to FIGS. 14–15, there is illustrated a comparison of the creep test run results of alloys (A–E)

processed in accordance with the present disclosure to an ASTM 11 and ASTM 9 grain size. The comparisons were done under isothermal test conditions of 1250° F. and 115KSI, and 1350° F. and 70 KSI. The tests which were run on smooth bar specimens are indicative of the time in hours to produce a plastic strain of 0.2% The coarsened grain size (ASTM 9) exhibited superior and expected results. However, the relative insensitivity of the 1250° F. results to compositional variations and the strong compositional effects for the ASTM 9 material tested at 1350° F. were not expected. Had the testing been only limited to the 1250° F. test conditions, the positive effects of increasing boron (alloys C, D, and E) and the zirconium addition (alloy D), as shown in FIG. 15, would have been missed.

With reference to Tables IV and V there is set forth representative tensile test results for materials of the present invention. The tensile tests were run at 70° F. and 1200° F. on the alloys (A–E) processed in accordance with the present disclosure to ASTM 11 and ASTM 9 grain sizes. The test results indicate an excellent overall balance of strength and ductility. An approximate five percent reduction in the 0.2% yield strength was observed for the ASTM 9 material as compared to the ASTM 11 material.

TABLE IV

Room Temperature (70° F.) Tensile Data

| | ASTM 9 GRAIN SIZE | | | | ASTM 11 GRAIN SIZE | | | |
|---|---|---|---|---|---|---|---|---|
| ALLOY | UTS KSI | 0.2% Y.S. KSI | % E1 | % RA | UTS KSI | 0.2% KSI | % E1 | % RA |
| A | 230.0 | 160.7 | 15.3 | 17.3 | 239.3 | 170.7 | 19.0 | 20.7 |
| B | 234.7 | 159.0 | 17.3 | 18.7 | 243.3 | 170.8 | 19.0 | 20.0 |
| C | 229.3 | 158.4 | 17.3 | 18.7 | 240.3 | 170.5 | 20.7 | 22.3 |
| D | 230.0 | 157.7 | 17.3 | 19.3 | 240.3 | 170.7 | 19.3 | 21.0 |
| E | 229.7 | 158.7 | 17.0 | 17.3 | 240.0 | 170.7 | 18.0 | 18.3 |

TABLE V

1200° F. Tensile Data

| | ASTM 9 GRAIN SIZE | | | | ASTM 11 GRAIN SIZE | | | |
|---|---|---|---|---|---|---|---|---|
| ALLOY | UTS KSI | 0.2% Y.S. KSI | % E1 | % RA | UTS KSI | 0.2% KSI | % E1 | % RA |
| A | 207.0 | 146.0 | 25.3 | 25.7 | 198.7 | 155.3 | 21.3 | 22.0 |
| B | 207.3 | 145.3 | 31.0 | 29.7 | 202.7 | 157.4 | 27.3 | 26.0 |
| C | 205.7 | 143.7 | 28.0 | 27.7 | 199.3 | 156.5 | 31.0 | 32.0 |
| D | 207.7 | 145.7 | 23.3 | 25.0 | 200.3 | 157.0 | 17.7 | 19.0 |
| E | 207.3 | 146.3 | 23.7 | 24.3 | 199.3 | 156.3 | 19.0 | 20.0 |

While the invention has been illustrated and described in detail in the drawings and foregoing description, the same is to be considered as illustrative and not restrictive in character, it being understood that the preferred embodiments have been shown and described and that all changes and modifications that come within the spirit of the invention are desired to be protective.

What is claimed is:

1. A composition consisting essentially of, in weight percent, 0.015%–0.035% carbon, 15.5%–16.5% chromium, 14%–15.5% cobalt, 2.75%–3.25% molybdenum, 4.75%–5.25% titanium, 2.25%–2.50% aluminum, 1%–1.5% tungsten, 0.030%–0.090% zirconium, 0.020%–0.030% boron, up to 0.90% hafnium, and the balance nickel plus incidental impurities.

2. A composition comprising in weight percent, about 0.025% carbon, about 0.020% boron, about 0.035% zirconium, about 16% chromium, about 5% titanium, about 2.5% aluminum, about 14.75% cobalt, about 3% molybdenum, about 1.25% tungsten, about 0.75% hafnium, and the balance nickel plus incidental impurities.

3. The composition of claim 2, having from about 0.035%–about 0.056% zirconium, and having from about 2.36%–about 2.50% aluminum.

4. The composition of claim 3, having about 0.056% zirconium.

5. A composition comprising in weight percent, about 0.025% carbon, about 0.030% boron, about 0.070% zirconium, about 16% chromium, about 5% titanium, about 2.5% aluminum, about 14.75% cobalt, about 3% molybdenum, about 1.25% tungsten, about 0.75% hafnium, and the balance nickel plus incidental impurities.

6. A gas turbine engine disk, comprising:

a main body member formed of a gamma prime strengthened wrought powder metallurgy composition consisting essentially of, in weight percent, 0.015%–0.035% carbon, 15.5%–16.5% chromium, 14%–15.5% cobalt, 2.75%–3.25% molybdenum, 4.75%–5.25% titanium, 2.25%–2.50% aluminum, 1%–1.5% tungsten, 0.030%–0.090% zirconium, 0.020%–0.030% boron, up to 0.90% hafnium, and the balance nickel plus incidental impurities; and said main body member has a substantially segregation free homogenous microstructure having an average grain size within a range of about 25 microns to about 3 microns.

7. The gas turbine engine disk of claim 6, wherein said main body member has a finished diameter within a range of about four inches to about thirty-two inches and has a finished weight within a range of about four pounds to about four hundred pounds.

8. The gas turbine engine disk of claim 6, wherein said main body member microstructure has an average grain size of about 8 microns.

9. The gas turbine engine disk of claim 6, wherein said main body member microstructure has an average grain size of about 16 microns.

10. The gas turbine engine disk of claim 6 which has an average grain size of about 16 microns, and wherein said main body member has been supersolvus solution heat treated at a temperature within a range of about 2130° F.–2150° F. for a length of time of about one to about four hours, followed by cooling at a rate of about 60° F./minute–about 600° F./minute to room temperature, and further followed by aging at a temperature of about 1400° F. for about eight hours and then air cooled to room temperature and aging at a temperature of about 1200° F. for about twenty-four hours and then air cooled to room temperature.

11. The gas turbine engine disk of claim 6 which has an average grain size of about 8 microns, and wherein said main body member has been subsolvus solution heat treated at a temperature within a range of about 2020° F.–2065° F. for about one to about four hours, followed by cooling at a rate of about 60° F./minute–about 600° F./minute to room temperature, and further followed by aging at a temperature of about 1400° F. for about eight hours and then air cooled to room temperature and aging at a temperature of about 1200° F. for about twenty-four hours and then air cooled to room temperature.

12. The gas turbine engine disk of claim 6, wherein said wrought powder metallurgy composition consisting essentially of, in weight percent, about 0.025% carbon, about 16% chromium, about 14.75% cobalt, about 3% molybdenum, about 5% titanium, about 2.5% aluminum, about 1.25% tungsten, about 0.035%–0.056% zirconium, about 0.020% boron, about 0.75% hafnium, and the balance nickel plus incidental impurities.

13. The gas turbine engine disk of claim 6, wherein said wrought powder metallurgy composition consisting essentially of, in weight percent, about 0.025% carbon, about 16% chromium, about 14.75% cobalt, about 3% molybdenum, about 5% titanium, about 2.5% aluminum, about 1.25% tungsten, about 0.070% zirconium, about 0.030% boron, about 0.75% hafnium, and the balance nickel plus incidental impurities.

14. A process of preparing a nickel base powder metal superalloy gas turbine engine disk, comprising:

furnishing a composition consisting essentially of, in weight percent, 0.015%–0.035% carbon, 15.5%–16.5% chromium, 14%–15.5% cobalt, 2.75%–3.25% molybdenum, 4.75%–5.25% titanium, 2.25%–2.50% aluminum, 1%–1.5% tungsten, 0.030%–0.090% zirconium, 0.020%–0.030% boron, up to 0.90% hafnium, and the balance nickel plus incidental impurities;

consolidating the composition to produce a perform member;

thermomechanically working the perform to produce a wrought member; and heat treating the wrought member.

15. The process of claim 14:

which further includes melting the composition to form an alloy melt material;

which further includes atomizing the alloy melt material to produce a quantity of powder metal particles of the alloy; and wherein said consolidating includes at least one of vacuum hot pressing, hot isostatic pressing, hot compaction, and extrusion.

16. The process of claim 15, wherein said consolidation occurring over a temperature range of about 1950° F. to about 2125° F.

17. The process of claim 14, wherein said thermomechanically working includes at least one of extruding, forging, rolling, and co-extruding,

18. The process of claim 17 wherein said thermomechanically working is defined by forging at a temperature within a range of about 1875° F. to about 2100° F., and said heat treating includes a supersolvus solution heat treatment.

19. The process of claim 18, wherein said supersolvus heat treatment is within a temperature range of about 2130° F. to about 2150° F. for about one to about four hours and said heat treating includes cooling the wrought member at a rate of about 60° F./minute to about 600° F./minute, and which further includes a two stage aging.

20. The process of claim 19, wherein said supersolvus heat treatment is occurring at about 2140° F. for about two hours and which further includes aging the wrought member after said heat treating.

21. The process of claim 14 wherein said thermomechanically working is defined by forging at a temperature within a range of about 1875° F.–about 2100° F. and said heat treating includes a subsolvus solution heat treatment.

22. The process of claim 21, wherein said subsolvus heat treatment temperature is within a range of about 2020° F. to about 2065° F. for about one to about four hours and said heat treating includes cooling the wrought member at a rate of about 60° F./minute to about 600° F./minute to an ambient temperature, and which further includes a two stage aging.

23. The process of claim 22, wherein said subsolvus solution heat treating is at about 2065° F. for about two hours and which further includes aging the wrought member after said heat treating.

24. The process of claim 21, wherein said forging is occurring at about 2065° F.

25. The process of claim 14, wherein said consolidating produces a fully dense preform member.

26. The process of claim 14:

which further includes melting the composition to form an alloy melt material;

which further includes atomizing the alloy melt material to produce a quantity of powder metal particles of the alloy;

wherein said consolidating is defined by hot isostatic pressing within a temperature range of about 1950° F. to about 2125° F.; and wherein said thermomechanically working is defined by forging.

27. The process of claim 14, wherein said consolidating includes extrusion and one of vacuum hot pressing, hot isostatic pressing and hot compaction.

28. A metal alloy consisting essentially of: in weight percent, 0.015%–0.035% carbon, 15.5%–16.5% chromium, 14%–15.5% cobalt, 2.75%–3.25% molybdenum, 4.75%–5.25% titanium, 2.25%–2.75% aluminum, 1%–1.5% tungsten, 0.030%–0.090% zirconium, 0.020%–0.050% boron, up to 0.90% hafnium, and the balance nickel plus incidental impurities, said metal alloy subjected to thermomechanical processing and heat treatment to produce an average grain size in the alloy of between about 3 microns and about 25 microns.

29. The metal alloy of claim 28 having a supersolvus temperature level greater than about 1162° C.(2125° F.).

30. The metal alloy of claim 28 having a substantially uniform microstructure.

31. The metal alloy of claim 28 wherein the alloy exhibits a microstructure that is substantially free of chemical segregation.

32. The metal alloy of claim 28 comprising between about 0.020%–0.030% boron.

33. The metal alloy of claim 28 comprising between about 2.25%–2.50% aluminum.

34. The metal alloy of claim 28 wherein thermomechanical processing comprises one or more of: extruding, forging, rolling, and co-extruding.

35. The metal alloy of claim 28 having, in weight percent, between about 0.035% and about 0.056% zirconium, and between about 2.36% and about 2.50% aluminum.

36. The metal alloy of claim 28 having in weight percent about 0.056% zirconium.

37. The metal alloy of claim 28 comprising, in weight percent, about 0.025% carbon, about 0.030% boron, about 0.070% zirconium, about 16% chromium, about 5% titanium, about 2.5% aluminum, about 14.75% cobalt, about 3% molybdenum, about 1.25% tungsten, about 0.75% hafnium, and the balance nickel plus incidental impurities.

38. The metal alloy of claim 28 formed into an article for use in a gas turbine engine.

39. The metal alloy of claim 28 wherein the article is a disk.

* * * * *

UNITED STATES PATENT AND TRADEMARK OFFICE

CERTIFICATE OF CORRECTION

PATENT NO. : 6,551,372 B1
DATED : April 22, 2003
INVENTOR(S) : Bruce A. Ewing et al.

It is certified that error appears in the above-identified patent and that said Letters Patent is hereby corrected as shown below:

Column 13,
Line 23, please change “perform” to -- preform --.
Line 25, please change “perform” to -- preform --.

Signed and Sealed this

Twenty-second Day of July, 2003

JAMES E. ROGAN
*Director of the United States Patent and Trademark Office*